US008293337B2

(12) United States Patent
Bhatnagar et al.

(10) Patent No.: US 8,293,337 B2
(45) Date of Patent: Oct. 23, 2012

(54) MULTIPLEXED ELECTROSPRAY DEPOSITION METHOD

(75) Inventors: Parijat Bhatnagar, Aloha, OR (US); Harold G. Craighead, Ithaca, NY (US)

(73) Assignee: Cornell University, Ithaca, NY (US)

( * ) Notice: Subject to any disclaimer, the term of this patent is extended or adjusted under 35 U.S.C. 154(b) by 545 days.

(21) Appl. No.: 12/490,138

(22) Filed: Jun. 23, 2009

(65) Prior Publication Data

US 2009/0317558 A1 Dec. 24, 2009

Related U.S. Application Data

(60) Provisional application No. 61/074,887, filed on Jun. 23, 2008.

(51) Int. Cl.
*B05D 1/04* (2006.01)
*B05D 3/10* (2006.01)

(52) U.S. Cl. ..... 427/466; 427/483; 427/485

(58) Field of Classification Search ..... 427/466, 427/483, 485
See application file for complete search history.

(56) References Cited

U.S. PATENT DOCUMENTS 4,748,043 A * 5/1988 Seaver et al. ..... 427/482
6,787,313 B2 9/2004 Morozov et al.
7,208,727 B2 4/2007 Fedorov et al.
7,361,311 B2 4/2008 Cooks et al.
7,381,373 B2 6/2008 Blake et al.
2005/0053954 A1 3/2005 Brennan et al.
2005/0130226 A1 6/2005 Ahn et al.
2006/0099704 A1 5/2006 Predki et al.
2006/0223185 A1 10/2006 Fedorov et al.
2007/0080246 A1 4/2007 Fedorov et al.
2007/0254091 A1* 11/2007 Fredrickson et al. ..... 427/2.24
2007/0278103 A1* 12/2007 Hoerr et al. ..... 205/80
2008/0199371 A1 8/2008 Voros et al.
2008/0227657 A1 9/2008 Cooks et al.
2009/0088329 A1 4/2009 Brennan et al.

OTHER PUBLICATIONS

Parijat Bhatnagar et al., "Protein functionalized micro hydrogel features for cell—surface interaction", Biomedical Microdevices, (2008) 10:567-571, Springer Netherlands, DOI:10.1007/s10544-008-9167-6.

Parijat Bhatnagar, "Multiplexed electrospray deposition for protein microarray with micromachined silicon device", Appl. Phys. Lett. 91, 014102 (2007), doi:10.1063/1.2754642.

* cited by examiner

*Primary Examiner* — Frederick Parker
(74) *Attorney, Agent, or Firm* — Miller, Matthias & Hull LLP

(57) ABSTRACT

Multiplexed electrospray deposition apparatus capable of delivering picoliter volumes of one or more substances is disclosed. The apparatus may include a unitary planar dispenser etched from a silicon wafer through microfabrication or micromachining technology. The apparatus may be used as a deposition tool for making protein microarrays in a noncontact mode. Upon application of potential difference in the range of 7-9 kV, the substances may be dispensed directly, not through a collimating mask, onto a substrate with microhydrogel features functionalized with an anchoring agent.

18 Claims, 4 Drawing Sheets

FIG. 5A
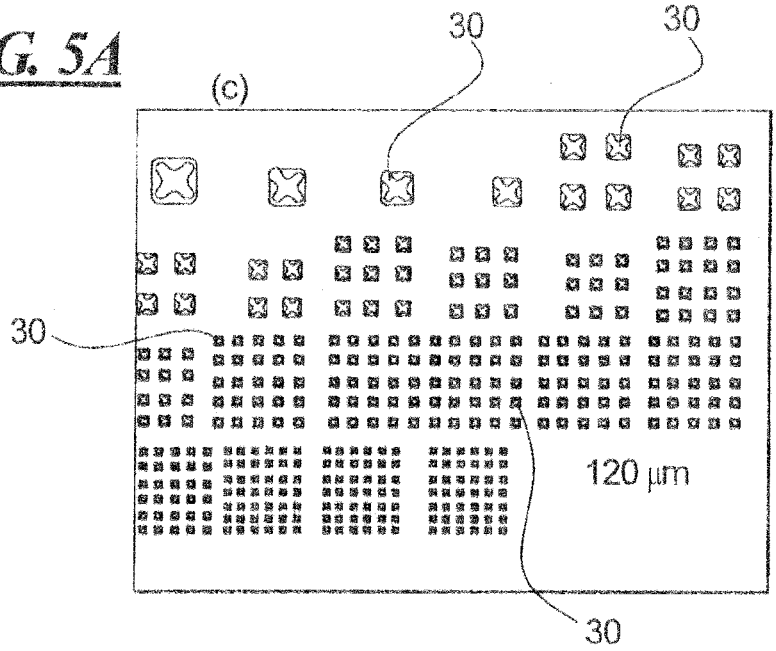
FIG. 5B
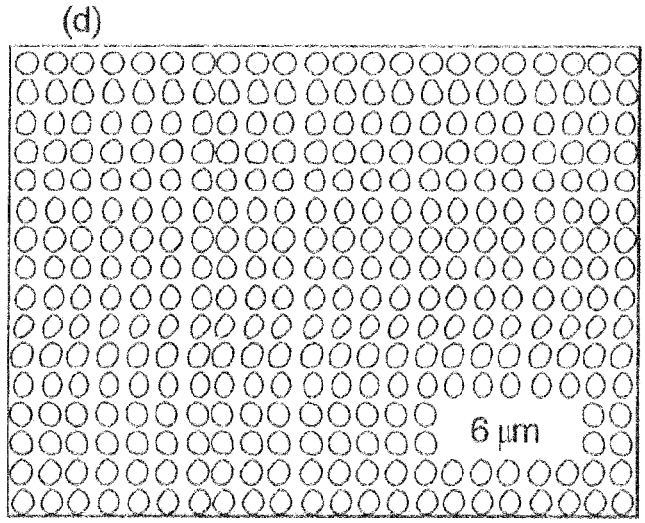
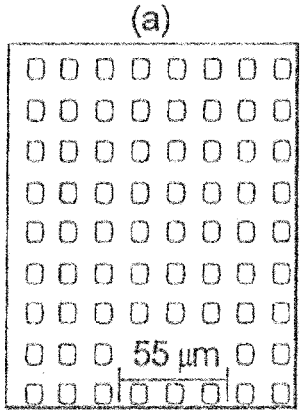
FIG. 6A
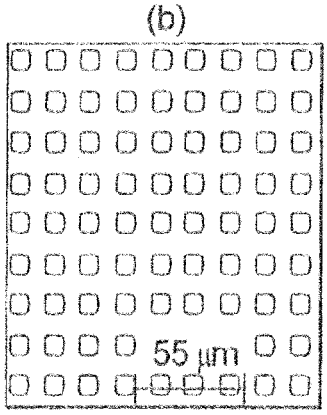
FIG. 6B
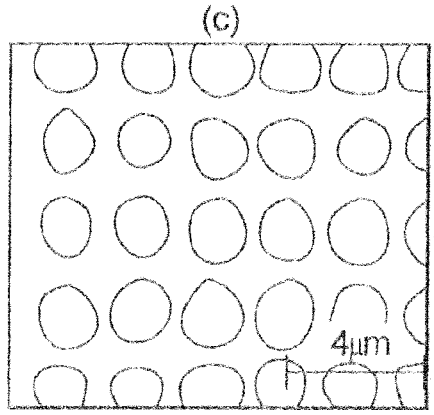
FIG. 6C (a)

(b)

MULTIPLEXED ELECTROSPRAY DEPOSITION METHOD

CROSS-REFERENCE TO RELATED APPLICATION

This application is based on and claims priority from U.S. provisional Application Ser. No. 61/074,887, filed on Jun. 23, 2008.

BACKGROUND

1. Technical Field

A multiplexed electrospray deposition apparatus capable of delivering picoliter volumes of one or more substances is disclosed. The apparatus may include a unitary planar dispenser etched from a silicon wafer through microfabrication or micromachining technology. The apparatus may be used as a deposition tool for making protein microarrays in a noncontact mode. Upon application of potential difference in the range of 7-9 kV, the substances may be dispensed directly, not through a collimating mask, onto a substrate with microhydrogel features functionalized with an anchoring agent.

2. Description of the Related Art

Electrospray Deposition (ESD) has lately emerged as an important technology for dispensing a small volume of a liquid composition by transforming it into a fine mist of droplets. Specifically, a high voltage electric field is applied to a capillary through which the liquid composition passes. In application, ESD may be used to spray or dispense various kinds of biomacromolecules and/or synthetic polymers, to form nano-sized particles and fibers, and to allow the biomacromolecules and/or synthetic polymers to accumulate and adhere on a substrate using electrostatic force. In addition, ESD has recently been widely used as an ionizer for mass spectrometers.

When a sample liquid stored in a thin capillary is supplied with several thousand volts relative to counter electrode, a strong electric field is generated at the tip of the capillary, due to the effect of electric field concentration. As the liquid begins to exit from the capillary, it forms a conical shape (Taylor cone) with the electrically charged ions gathered on its surface. Subsequently, when the electrostatic force becomes stronger than surface tension, the liquid erupts from the tip of the capillary to form a fine jet. Since the jet is highly charged, the liquid immediately turns into fine droplets to generate spray with each droplet split from the next by electrostatic force. Because the droplets formed by means of electrospray are tiny, the solvent evaporates and dries in a very short period of time. As a result, charged nano-particles may be formed, which may be subsequently attracted to the counter-electrode by electrostatic force. If desired, the liquid can be sprayed in a pattern controlled by masks made of insulating material and/or additional electrodes.

The particles of materials fabricated by ESD may have diameters of as little as less than dozens of nano-meters. Using this technique, various types of coating may be deposited on a surface, wherein the coatings may include materials like synthetic polymers and biomacromolecules (e.g. proteins). Thickness of the coating is controllable at the level of nano-meters, and with the electrostatic force, it is theoretically possible to coat the substrate both of flat surfaces or of complex shapes. By using a mask of insulating material in the ESD method, electrostatic force controls the pattern of deposition and forms it in desired shape, either spotted or striped. The resolution of the deposit ranges from micron-scale to sub-micron-scale.

In general, features of ESD may include, but are not limited to: (1) spraying and depositing various substances such as organic/inorganic compounds, biomacromolecules and/or synthetic polymers; (2) maintaining the sample relatively free from damage, as ESD processes may be conducted under desired temperature and atmospheric pressure; (3) creating nano-sized particles and fibers; (4) controlling the depositions and patterns of the particle using electrostatic force; and (5) sample deposition in larger areas with batch processes.

Lab-on-a-chip technologies have received considerable attention recently as a result of an integrated effort put forth by the life science and physical science community to create functional platforms for cell-surface interactions, early disease detection, personalized medicine, drug discovery, and single molecule analysis. By utilizing minimal volumes of the biological molecules and reagents, this technology may lead to higher throughput, improved sensitivity, and faster speed in scientific research and development.

To deposit samples on the chip, techniques such as spotting, ink-jet, and micro-contact printing have been developed and generally employed. ESD has also been used to generate arrays of protein in noncontact mode applicable to the creation of biochips, including that of protein chips. To that end, ESD may provide higher resolution and greater use in mass chip fabrication with batch processes, thereby overcoming technical limitations in conventional methods and meeting various laboratory needs.

While capillaries and electrically collimating dielectric masks have been used to make protein arrays using ESD processes, these techniques cannot be integrated in planar microfabrication schemes of the lab-on-a-chip and introduce an added complexity of aligning an ESD apparatus to a collimating mask, which needs to be further aligned to surface features formed on grounded protein array chips. Furthermore, to provide multiplexing capability to the ESD apparatus, it is important that multiple source tips of ESD apparatus be equidistant from the surface. A slight misalignment of the different source tips in ESD apparatus can cause the failure of all but one with the closest ground surface proximity, thereby limiting the multiplexing capability of the ESD apparatus.

Hence, there is a need for a robust and reliable ESD apparatus that can dispense and deposit, either simultaneously or sequentially, one or more samples in small volumes onto a substrate surface. Moreover, there is a need for an ESD apparatus that can be manufactured through convenient planar microfabrication and micromachining. Finally, there is a need for a reliable and efficient process to deposit samples on a substrate through a mask-less ESD process.

SUMMARY OF THE DISCLOSURE

In satisfaction of the aforementioned needs, ESD apparatus and method for deposition of one or more substances onto a substrate without the use of a collimating mask is disclosed. The apparatus may include a mounting bracket in electric connection with a high voltage source and a grounded stage with a planar top surface separated from the mounting bracket. The apparatus includes a unitary planar dispenser having a base and a plurality of dispensing legs extending from the bottom edge of the base. Each dispensing leg has a single-edged tip to prevent charge accumulation at the corners, which may lead to undesirable multiple flows and corona discharge patterns.

When the dispenser is mounted on the mounting bracket, the tips of the dispensing legs may be equidistant from the planar top surface of the grounded stage so as to provide reliable and consistent dispensing of the substances. It is contemplated that misalignment of tips may result in dispensing of the substances only from the tip closest to the planar surface of the stage. To prevent such failure, the planar dispenser may be etched from a silicon wafer in monolithic fashion through microfabrication for precise formation of aligned tips.

According to this disclosure, the substances may be deposited onto a substrate without the use of a collimating mask, which improves the efficiency and reliability of the manufacturing of biochips. To that end, one or more microhydrogel features are formed on the substrate. In one embodiment, the substrate is silicon oxide and the microhydrogel features are acrylamide-based and covalently bonded to the substrate.

In order to immobilize the dispensed substances on the substrate, the microhydrogel features may be functionalized with an anchoring agent capable of being bonded to the substances. In one embodiment, the substances to be dispensed, such as proteins, may include an amino group and the anchoring agent may be an aldehyde. The substance may be further immobilized by formation of Schiff base between the amino and aldehyde groups followed by reductive amination.

To use the ESD apparatus, liquid compositions of the substances are prepared, which may further include a nonionic surfactant in order to reduce non-specific binding of the substance onto the dispensing legs and/or substrate surfaces not covered by the microhydrogel features. The liquid compositions may be loaded onto the dispensing legs by micropipette or other liquid transfer apparatus known in the art. The liquid composition may also be loaded on a microfabricated reservoir with a capillary extending to the tip of the dispensing leg.

Before, during or after the loading of the liquid compositions, the substrate (with functionalized microhydrogel features provided thereon) may be placed on the grounded stage and aligned to the dispensing legs of the ESD apparatus. A potential difference (e.g. from about 7 kV to about 9 kV) is applied to the dispensing legs and the substrate so that the liquid compositions may be dispensed on the substrate as fine liquid droplets. As a result, small volumes (e.g. picoliters) of substances may be deposited and immobilized on the microhydrogel features by the disclosed apparatus and method. Dispensed substances that are not bonded to the microhydrogel features may be easily removed from the substrate, such as by washing or other processes known in the art.

Other advantages and features of the disclosed methods and apparatus will be described in greater detail below. It will also be noted here and elsewhere that the apparatus or method disclosed herein may be suitably modified to be used in a wide variety of applications by one of ordinary skill in the art without undue experimentation.

BRIEF DESCRIPTION OF THE DRAWINGS

For a more complete understanding of the disclosed apparatus and method, reference should be made to the embodiments illustrated in greater detail in the accompanying drawings, wherein:

FIG. 5A is an optical microscopic image of microhydrogel features of various dimensions formed on a substrate;

FIG. 5B is an SEM image of microhydrogel features of 1 μm;

FIG. 6A is an epifluorescence image of Biotin deposition on microhydrogel features of 8 μm, probed by a solution of streptavidin-Alexa 594 conjugate;

FIG. 6B is an epifluorescence image of Protein A on microhydrogel features of 8 μm, probed by a solution of rabbit antimouse IgG-Alexa 488 conjugate;

FIG. 6C is epifluorescence image of Protein A on microhydrogel features of 1 μm, probed by a solution of rabbit antimouse IgG-Alexa 488 conjugate;

It should be understood that the drawings are not necessarily to scale and that the disclosed embodiments are sometimes illustrated diagrammatically and in partial views. In certain instances, details which are not necessary for an understanding of the disclosed apparatus or method which render other details difficult to perceive may have been omitted. It should be understood, of course, that this disclosure is not limited to the particular embodiments illustrated herein.

DETAILED DESCRIPTION OF THE PRESENTLY PREFERRED EMBODIMENTS

This disclosure is generally related to an electrospray deposition apparatus capable of delivering picoliter volumes. In particular, the disclosed apparatus is multiplexed in its operation to dispense a plurality of substances onto a substrate. The apparatus may include a unitary planar dispenser etched from a silicon wafer through microfabrication or micromachining technology. The apparatus may be used as a deposition tool for making protein microarrays in a noncontact mode. Upon application of a potential difference, liquid compositions of the substances may be dispensed directly, not through a collimating mask, onto a substrate with microhydrogel features functionalized with an anchoring agent.

Figure 1:
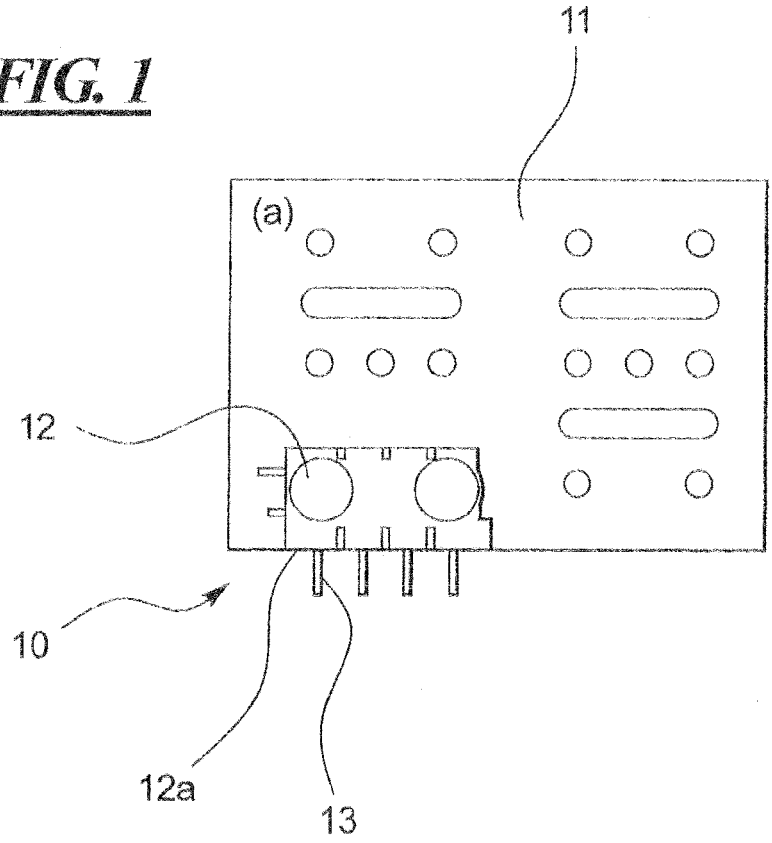
FIG. 1 is a photographic illustration of an ESD apparatus according to one aspect of this disclosure.
Figure 2:
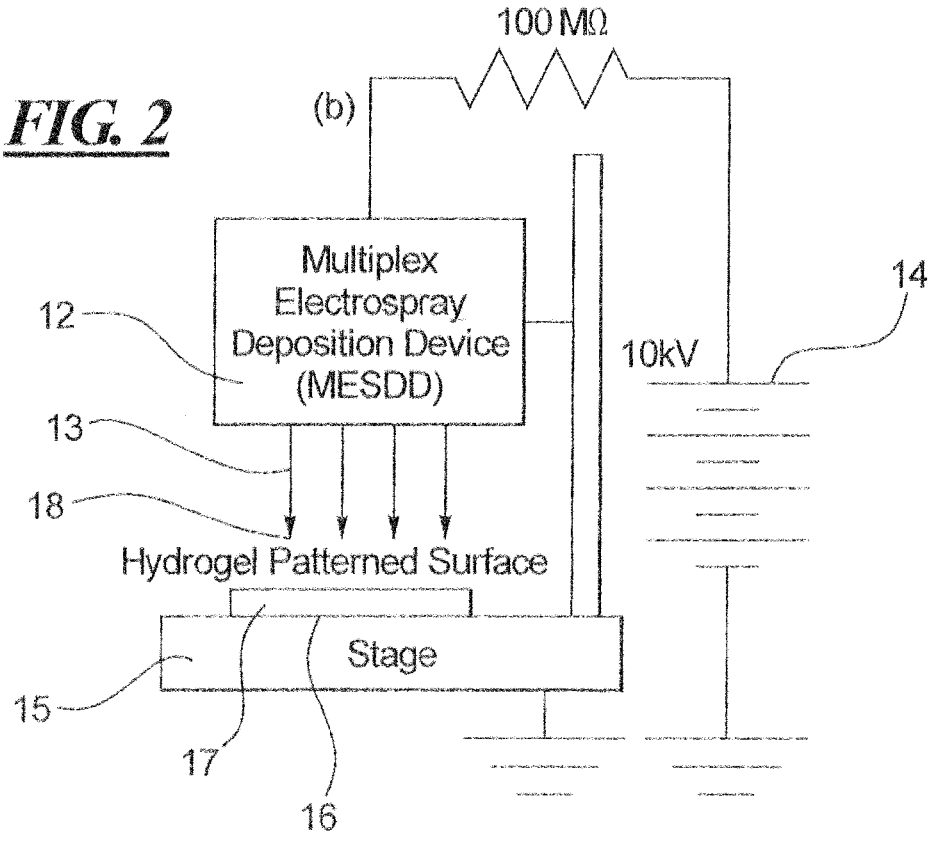
FIG. 2 is a circuit diagram of the ESD apparatus shown in FIG. 1.

Referring to FIGS. 1-2, an ESD apparatus 10 according to one aspect of this disclosure includes a mounting bracket 11 and a dispenser 12 mounted thereon. The dispenser 12 may include a base 12*a* and a plurality of dispensing legs 13 extending from the bottom edge of the base 12*a*. Each dispensing leg 13 may be loaded with a liquid composition of a substance to be deposited. As illustrated in FIG. 2, the mounting bracket 11 may be electrically connected to a high voltage source 14. The apparatus 10 also includes a grounded stage 15 having a planar surface 16, upon which a substrate 17 can be placed for receiving the substances dispensed from the dispensing legs 13.

The substrate 17 is conductive enough to allow electrospray deposition. In one embodiment, the substrate 17 is silicon oxide. Other materials, such as plastic material conductive enough to allow epectrospray deposition, may also be used.

Figure 3:
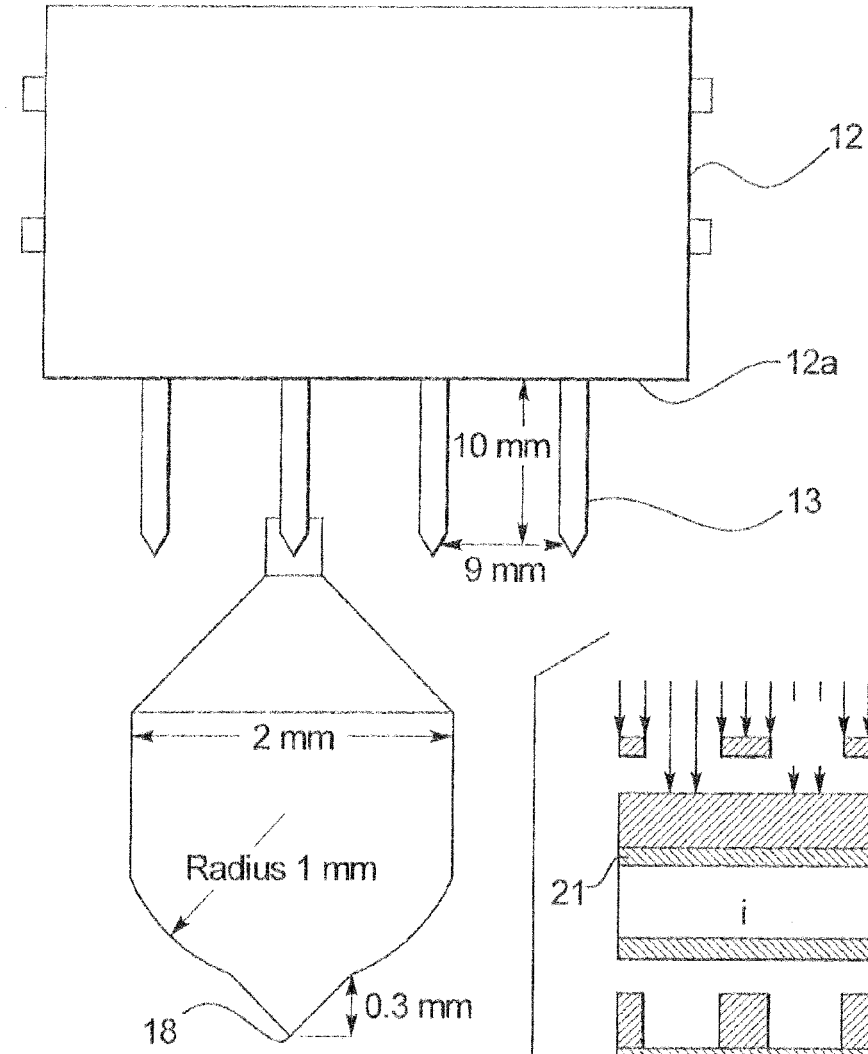
FIG. 3 is a graphic illustration of the shape and dimensions of a planar dispenser used in ESD apparatus shown in FIG 1.

Turning to FIG. 3, the dispensing legs 13 each include a tip 18 through which the liquid compositions are dispensed. The dispensing legs 13 may be parallel with each other. In one embodiment, the dispensing legs 13 are all vertical. As illustrated in FIG. 3, each dispensing leg 13 has a single-edged tip 18 to prevent charge accumulation at the corners, which may lead to undesirable multiple flows and corona discharge patterns.

Figure 4:
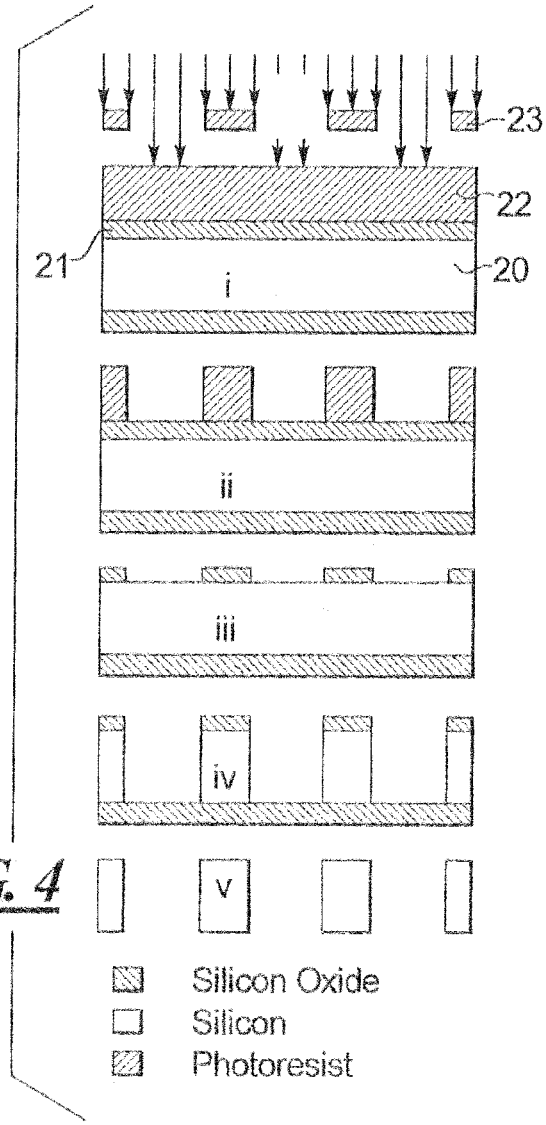
FIG. 4 is a schematic illustration of a process for making the planar dispenser of FIG. 3.

Turning back to FIG. 2, the tips 18 of the dispensing legs 13 are equidistant from the planar surface 16 and hence substrate 17 of the grounded stage 15 in order to provide reliable and consistent dispensing of the substances. Misalignment of tips 18 may result in dispensing of the substances only from the tip closest to the substrate 17 on the grounded stage 15. To prevent such failure, the planar dispenser 12 may be etched from a silicon wafer in monolithic fashion through microfabrication for precise formation of aligned tips, as illustrated in FIG. 4 and described in greater detail below.

The unitary planar dispenser 12 is formed through a standard integrated microfabrication process according to the following steps: (i) a double-sided polished silicon wafer 20 with 2 μm silicon oxide coating 21 (Silicon Quest International, Inc., 1230 Memorex Drive, Santa Clara, Calif. 95050, http://www.siliconquest.com) is coated with 5 μm photoresist 22 and exposed with a design mask 23 using contact photolithography (the shape of the design mask 23 is also illustrated in FIG. 3); (ii-iii) the resulting photoresist patterned wafer is subjected to $CHF_3$—$O_2$ based reactive ion etch process to etch the patterned 2 μm silicon oxide coating 21; (iv) the remaining silicon oxide coating 21 is then used as a hard mask for deep silicon etching; and (v) the silicon oxide hard mask 21 is stripped using hydrofluoric acid to obtain the dispenser 12.

The microfacricated silicon planar dispenser 12 is then claimed out of the wafer 20 by breaking the rest of the wafer, after which the dispenser 12 is functionalized with self-assembled monolayer (SAM) of methoxy(polyethyleneoxy) propyl trimethoxysilane (6-9 polyethylene glycol units) (Gelest, inc., 11 East Steel Rd., Morrisville, Pa. 19067, http://www.gelest.com). Without wishing to be bound by any particular theory, this functionalization may prevent nonspecific adhesion of the substance to the silicon surface of the dispenser 12 during sample loading. It is to be understood that this functionalization is optional and may be carried out by using other methods known in the art.

To improve the efficiency and reliability of biochip manufacturing, the substances may be deposited onto the substrate 17 without the use of a collimating mask. As illustrated in FIGS. 5A and 5B, one or more microhydrogel features 30 of various dimensions may be formed on the substrate 17. In one embodiment, the substrate 17 is silicon oxide and the microhydrogel features 30 are acrylamide-based and covalently bonded to the substrate 17.

Moreover, in order to immobilize the dispensed substances on the substrate 17, the microhydrogel features 30 may be functionalized with an anchoring agent capable of being bonded to the substances. In one embodiment, the substances to be dispensed, such as proteins, may include an amino group and the anchoring agent may be an aldehyde that can form a Schiff base with the amino group. In a refinement, the substance may be further immobilized through reductive amination. Preparation and functionalization of the microhydrogel features 30 are described in greater detail below.

Patterning of Parylene C Film

Parylene C polymer film (1-5 μm thick) deposited (chemical vapor deposition) on 100 mm diameter thermally oxidized silicon wafer was patterned using standard projection photolithography. The patterns were transferred into the parylene C film using oxygen plasma in PlasmaTherm 72 reactive ion etcher (electrode area 585 $cm^2$). Microfabrication equipments at Cornell NanoScale Science and Technology Facility (CNF) were employed.

Polymerization of Hydrogel Thin Film

Parylene C patterns were treated for 2 min with 3% (v/v) solution of 3-methacryloxypropyl(trimethoxysilane) (Sigma-Aldrich Corp., St. Louis, Mo., USA) in 95% ethanol, 4.7% water and 0.3% acetic acid. Five percent (w/v) monomer (95% acrylamide and 5% methylenebisacrylamide (w/w)) was dissolved in 0.01 M PBS with 40% glycerol (v/v). Free radicals were generated by addition of 4 μl of 25% (w/v) of ammonium persulfate and 4 μl of N,N,N',N'-tetramethylethylenediamine (Bio-Rad Laboratories, Hercules, Calif., USA) per milliliter of gel precursor solution. Pre-polymerized hydrogel solution was dispensed on the wafer and polymerized overnight. The parylene C polymer film was then mechanically lifted, thereby leaving the microhydrogel features on the silicon wafer.

Aldehyde Functionalization of Hydrogel

The substrate with microhydrogel features was treated with aqueous 0.1 M $NaIO_4$ for 20 min followed by 5% glutaraldehyde (in 0.1 M sodium phosphate buffer) for 48 h.

To evaluate the performance of the disclosed ESD apparatus and method, two sample substances were deposited on substrates with microhydrogel feature of various dimensions. In particular, Protein A (10 μl, 5 mg/ml) and Biotin (10 μl, 2 mg/ml) solutions in phosphate buffered saline (PBS) with 0.5% Triton X-100 (a nonionic surfactant) were loaded by micropipette on the alternate tips 18 of the planar dispenser 12. Parallel streams of solutions in fine particles were observed from all four tips in a conejet mode when the potential difference at positive polarity in the range of +7 to +9 kV (Series EH, Glass-man High Voltage, Inc., High Bridge, N.J.) was applied between the apparatus 10 and the grounded microhydrogel-featured substrate 17.

Without being wishing to be bound by any particular theory, it is contemplated that the addition of non-ionic surfactant (Triton X-100) may contribute to the cone-jet flow mode. The nonionic surfactant may also help eliminate the nonspecific adhesion of the proteins on the dispensing legs 13, as well as on the substrate 17 in the silicon oxide area between the microhygrogen features. The surface with deposited proteins was incubated for 3 h at room temperature and treated with aqueous 0.1M NaBH4 (20 min) for reductive amination of Schiff bases that formed between primary amine groups of Protein A or Biotin and aldehyde functionalized microhydrogel features. Substances deposited on the substrate but not on the microhydrogel features were removed from the substrate during subsequent washing.

In order to visualize the deposition of the substances on the substrate, the microhydrogel-featured substrate with Protein A and/or Biotin immobilized thereon through reductive amination was then treated with Starting Block T20 (PBS) Blocking Buffer (1 h) (Pierce Biotechnology, Inc., Rockford, Ill.) and probed with a solution containing Alexa-488 labeled rabbit antimouse IgG (4 μg/ml) and Alexa-594 labeled streptavidin (4 μg/ml) (Molecular Probes, Invitrogen, Inc., Carlsbad, Calif.) in PBS with 0.5% Triton X-100 (1 h).

Figure 7A:
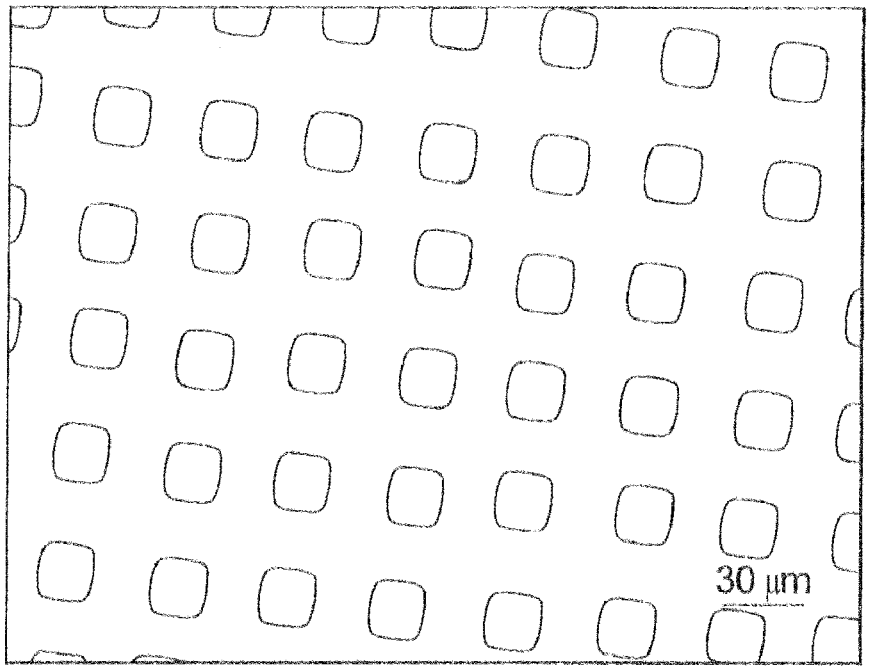
FIG. 7A is an epifluorescence image of Protein A on microhydrogel features not functionalized with aldehyde, probed by a solution of rabbit antimouse IgG-Alexa 488 conjugate.
Figure 7B:
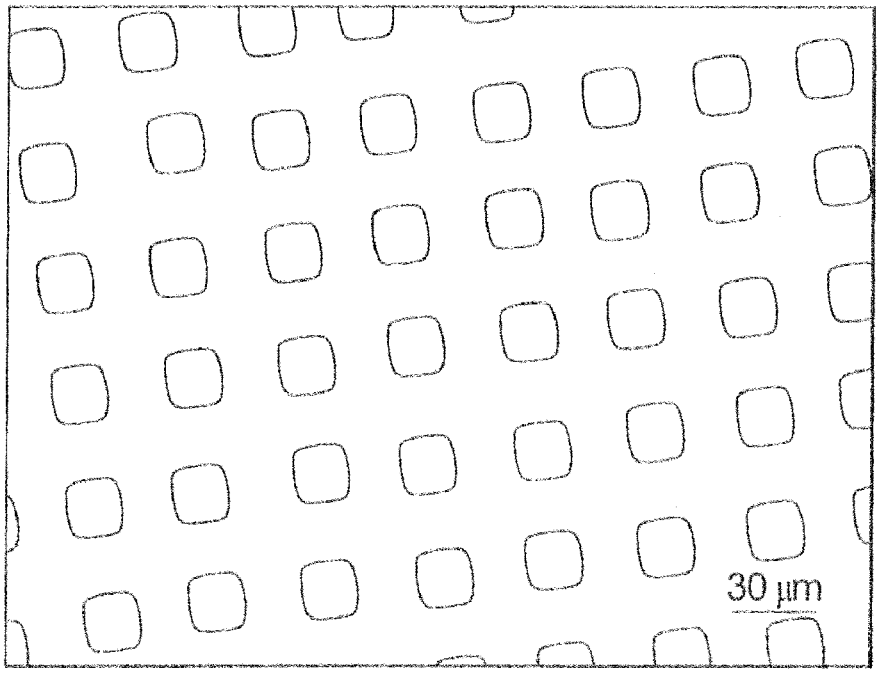
FIG. 7B is an epifluorescence image of Protein A on microhydrogel features functionalized with aldehyde, probed by a solution of rabbit antimouse IgG-Alexa 488 conjugate.

As illustrated in FIGS. 6A-C, epifluorescence microscopic detection (water immersion objective, model AX70, Olympus America, Inc., Center Valley, Pa.) of immobilized Protein A and Biotin was obtained on different areas of microhydrogel features on the same substrate. In addition, FIGS. 7A-B illustrate that the substances (Protein A and Biotin) only specifically bind to the microhydrogel features through covalent amide bonds and not to the silicon oxide backbone of the substrate. Specifically, if Protein A was deposited on a microhydrogel-featured substrate that was not functionalized with aldehyde, as illustrated in FIG. 7A, no epifluorescent detection was recorded, which also indicate that the probe molecules do not bind to the hydrogel features at the absence of Protein A. On the other hand, if Protein A was deposited on a microhydrogel-featured substrate that was functionalized with aldehyde, as illustrated in FIG. 7B, epifluorescent detection was recorded, indicating specific binding of the protein with the functionalized microhydrogel features.

In addition to the use of functionalized microhydrogel features to anchor the substances, protein arrays may also be formed through controlled movement of the ESD device or the substrate in the X-Y plane while activation/deactivating the ESD device to dispense the substances at desired locations.

Another application of the disclosed ESD apparatus and method is to synergistically improve microfluidic approaches directed toward planar apparatus designed for consuming lower analyte volumes. To that end, a complementary effort toward delivering smaller volumes to the microfluidic channels would exponentially improve the capability of the integrated apparatus. Thus, providing a multiplexed capability using the disclosed apparatus and methods may further enhance the throughput of lab-on-a-chip.

Interfacing the macroenvironment with on-chip microfluidic network has also been identified as a major challenge in the microfluidics. It is contemplated that the disclosed apparatus may provide a solution for this problem by replacing pumps, which are still comparatively large, with on-chip reservoir and multiplexed electrospray injection at the microfluidic interfaces.

While only certain embodiments have been set forth, alternative embodiments and various modifications will be apparent from the above descriptions to those skilled in the art. These and other alternatives are considered equivalents and within the spirit and scope of this disclosure.

What is claimed is:

1. A method for mask-less deposition of a substance onto a substrate, the method comprising:

loading a liquid composition of the substance onto an electrospray deposition apparatus including a dispensing leg, the substrate comprising at least one microhydrogel feature functionalized with an anchoring agent capable of being bonded to the substance;

aligning the substrate with the dispensing leg; and spraying the substance as fine particles onto the substrate by applying a potential difference between the dispensing leg and the substrate.

2. The method of claim 1, wherein the substrate is silicon oxide.

3. The method of claim 1, wherein the microhydrogel feature is acrylamide-based and is covalently bonded to the substrate.

4. The method of claim 1, wherein the substance comprises an amino group and the anchoring agent comprises an aldehyde.

5. The method of claim 1, further comprising the step of permanently immobilizing the substance on the microhydrogel feature by reductive amination.

6. The method of claim 1, further comprising the step of removing from the substrate the substance that is not bonded to the microhydrogel feature.

7. The method of claim 1, wherein the liquid composition further comprises a nonionic surfactant.

8. The method of claim 1, wherein the dispensing leg has a single-edged tip.

9. The method of claim 1, wherein the potential difference is from about 7 kV to about 9 kV.

10. A method for mask-less deposition of a plurality of substances onto a substrate, the method comprising:

loading a plurality of liquid compositions each containing one of the substances onto an electrospray deposition apparatus including a plurality of dispensing legs, the substrate comprising at least one microhydrogel feature each functionalized with an anchoring agent capable of being bonded to at least one of the substances;

aligning the substrate with the dispensing legs; and spraying the plurality of substances as fine particles onto the substrate by applying a potential difference between the dispensing legs and the substrate.

11. The method of claim 10, wherein the substrate is silicon oxide.

12. The method of claim 10, wherein the microhydrogel feature is acrylamide-based and is covalently bonded to the substrate.

13. The method of claim 10, wherein each of the substances comprises an amino group and the anchoring agent comprises an aldehyde.

14. The method of claim 10, further comprising the step of permanently immobilizing the substances on the microhydrogel feature by reductive amination.

15. The method of claim 10, further comprising the step of removing from the substrate the substance that is not bonded to the microhydrogel feature.

16. The method of claim 10, wherein each of the liquid compositions further comprises a nonionic surfactant.

17. The method of claim 10, wherein the dispensing legs are parallel to each other and each dispensing leg has a single-edged tip.

18. The method of claim 10, wherein the potential difference is from about 7 kV to about 9 kV.

* * * * *